252-103 AU 166 EX
9/21/82 XR 4,350,034

United States Patent [19]
Godek et al.
[11] 4,350,034
[45] * Sep. 21, 1982

[54] METAL DRAWING COMPOUND COMPOSITION AND METHOD OF USE

[75] Inventors: James L. Godek, Lincoln Park; Lawrence P. Gowman, West Bloomfield, both of Mich.

[73] Assignee: Wayne Chemical Products Company, Detroit, Mich.

[ * ] Notice: The portion of the term of this patent subsequent to Apr. 14, 1998, has been disclaimed.

[21] Appl. No.: 199,734

[22] Filed: Oct. 23, 1980

Related U.S. Application Data

[63] Continuation-in-part of Ser. No. 50,753, Jun. 21, 1979, Pat. No. 4,262,057.

[51] Int. Cl.³ ..... B21B 45/02; B21C 1/00
[52] U.S. Cl. ..... 72/42; 72/46; 252/32; 252/97; 252/99; 252/103; 252/135; 428/469; 428/470
[58] Field of Search ..... 252/97, 99, 103, 105, 252/135, 32; 428/457, 470, 469, 539, 688, 702; 72/46; 148/11.5 R, 6.14 R

[56] References Cited

U.S. PATENT DOCUMENTS

| | | | |
|---|---|---|---|
| 2,343,036 | 2/1944 | Wilson | 252/32 |
| 2,372,052 | 3/1945 | Beerbower | 252/32 |
| 2,876,200 | 3/1959 | Strain | 252/97 |
| 2,975,139 | 3/1961 | Kaufmann | 252/99 |

*Primary Examiner*—Ellis P. Robinson

[57] ABSTRACT

A metal drawing compound is described which is formed by dipping or otherwise coating metal drawing stock with an aqueous soap-borate composition having a pH in the range of from about 7.6 to less than about 9.0. The solution can be allowed to dry on the workpiece, or can be used as a wet film and then drawn conventionally. In a preferred embodiment of the invention the soap-borate composition is prepared by admixture with a borate compound selected from the group consisting of potassium pentaborate, ammonium pentaborate and sodium octaborate in neutral pH water of solution.

3 Claims, No Drawings

METAL DRAWING COMPOUND COMPOSITION AND METHOD OF USE

CROSS-REFERENCE TO RELATED APPLICATION

This is a continuation-in-part application of our application Ser. No. 50,753, filed June 21, 1979 now U.S. pat. No. 4,262,057.

BRIEF SUMMARY OF THE INVENTION

Applicants are aware of U.S. Pat. Nos. 2,876,200; 2,343,036; 2,372,052; and 2,975,139. U.S. Pat. No. 2,876,200 describes a method for producing a non-segregating granular detergent having bleaching power. There is no disclosure therein that any product made by the method described has lubricant characteristics or provides a film with good corrosion protection. The remaining patents heretofore referred to have no relevance to applicants invention.

It is conventional to prepare dry film, metal drawing compounds by admixing high titer soap (normally containing stearates and palmitates) and borax (sodium tetraborate pentahydrate), and then applying said composition to the metal surface at a dilution of about 12–20 ounces per gallon in water at elevated temperatures within a range of from 150°–180° F.; after said application, the work is dried to produce the desired thin film coating. While it is possible to form various metal shapes on presses with work coated with these conventional soap-borax compositions, severe deformation is not possible in that excessive die wear and poor die life can take place. Moreover, in the case of such heavy deformations, it is not possible to produce quality work since the parts so deformed may wrinkle or show incipient welding with the die. Such welding might take the form of welding and then scoring. Furthermore, these conventional soap-borax compositions render substantially no corrosion resistance toward ferrous substrates, i.e. a conventional soap-borax film applied on a carbon steel surface shows uniform, almost complete rust over the entire steel surface in 24 hours in the standard Cleveland Condensing Cabinet (where the coated surface is exposed to a consistent, condensing atmosphere of water at 100° F.). The necessity of applying conventional soap-borax dry film forming solutions at elevated temperatures is due to the fact that such solutions tend to become highly viscous, in fact gel-like, at temperatures below about 150° F. An ambient temperature solution is highly desirable.

Conventional soap-borax systems cannot be used as "wet" compounds because they have little lubrication value and because they cannot be applied at ambient temperatures due to the gelling tendencies of the solutions. Their use as a drawing compound is only as a dry film.

In the face of the above-mentioned limitations of conventional soap-borax dry film coatings, industry has utilized more expensive non-aqueous lubricant type compositions such as chlorinated compounds and chlorinated molybdenum disulfide containing compounds for severe drawing. In addition to the added expense of these compounds, they often leave undesirable organic coatings upon the metal surface which present cleaning problems.

We have now surprisingly discovered that a novel dry-film metal drawing compound is formed when certain soap-borax compositions are formulated in aqueous solutions having a pH within the range of from about pH 7.6 to less than about pH 9. The conventional borax composition in aqueous solution is at least pH 9.0. The aqueous compositions of this invention may be prepared by dissolving a borate containing compound which on solution at from 0.01 M to saturation gives a pH in neutral water of from about 7.6 to less than about 9.0, and mixing this solution with an appropriate soap. On the other hand, a borax solution or other solution of a borate containing compound which upon solution gives a pH of at least about 9.0 may receive a pH adjustment by organic or inorganic acids to bring the same within the range of from about 7.6 to less than about 9.0. In addition to the unique properties of this compound as a dry film, aqueous solution in the described pH range can function well as a wet film comparable to conventional paste type drawing compounds.

DETAILED DESCRIPTION OF THE INVENTION

In the following examples of the preparation and use of the compositions of this invention corrosion tests were carried out in a Q-C-T Cyclic Environmental Tester in accordance with ASTM D-2247-68.

Also in the following examples, the drawability of coated strips was determined by use of a machine consisting essentially of two components. The first component is a die block assembly which holds flat dies in position and provides the hydraulic loading on the dies and test strip while remaining stationary during the test. The second component is a gripping assembly which holds one end of the test strip and moves upward pulling the other end of the strip through the stationary dies. The force needed to move this gripping assembly while the coated test strip is between the dies provides a measure of the lubrication provided by the coating on the test strip. In accordance with the testing procedure test panels (Q-Panel Co.) of standard QD-412 cold rolled steel are dip coated in the test solution for two minutes and air dried for at least two hours. No differences were found if the panels were oven dried at 150° F. for ten minutes. The two flat dies are cleaned with isopropyl alcohol to remove any residual lubricant from the previous test, redressed with fine grade emery paper and wiped with alcohol again. The coated test strip is then placed between the dies and load applied to the dies. The other end of the test strip is placed between the jaws of the gripping assembly and the machine started. The gripping assembly moves upward and as it does the jaws move closer together until they grip the test strip. This allows a uniform and consistent rate of loading of the strip. At this point, the other end of the strip begins to move between the dies. The pressure necessary to keep the gripping assembly moving at a constant rate is shown on a pressure gauge and automatically recorded by a pressure transducer. After the draw, the dies and test strip are examined for transfer of lubricant from the test strip to the dies and rated as none (5), slight (4), moderate (3), severe (2), or total (1). Excessive transfer of the lubricating drawing compound precludes the use of the material in normal production where the material could build up in dies and affect tolerances. The recorded drawing forces are examined and rated as 5 for very low force, i.e. excellent drawability and 1 for very high force, or very poor drawability. The final drawability rating was achived by multiplying the material transfer index by 60 percent and the drawing force index by 40 percent. These two numbers were then added and rounded off to the closest integer to yield an overall drawability rating. If total transfer of material occurred or the dies were scored by the test strip, the drawability index was automatically set at 1 (poor).

In evaluating the aqueous solutions of our compound as a wet film the above mentioned equipment was used. However, the rating method used for a wet film is different. Normal water based paste compounds are evaluated by determining the amount of force necessary to draw the coated strips through the dies. The evaluation range for most wet film water based paste drawing compounds is between 900 and 2200 pounds as compared to the 200 to 700 pounds range found with dry film.

EXAMPLE 1

A solution was prepared by mixing with moderate agitation at 130° F., 5 percent sodium tetraborate pentahydrate, 90 percent water and 5 percent of a sodium soap with a typical fatty acid composition of 6.3 percent myristic acid, 27.4 palmitic acid, 14.1 stearic acid, 49.0 oleic acid and 3.2 percent linoleic acid. At 60° C. this solution had a pH of 9.0 and a viscosity if 16 seconds as measured by a No. 5 Zahn cup. A coating of this solution dip applied at 60° C. and allowed to dry for 2 hours at 27° C. yielded a drawability rating of 4. This solution could not be applied at 30° C. because it formed a hard gel. The same solution was then treated with 1.0 N hydrochloric acid to a pH of 8.4. The solution viscosity dropped to 12 seconds at 60° C. and the drawability rating remained at 4. This solution also could not be run at 30° C. because of gel formation. The pH was then further adjusted to 7.8. At this point there was a dramatic decrease in viscosity to 6 seconds at 60° C. and 7 seconds at 30° C. Test panels coated at both these temperatures yielded drawability ratings of 5.

EXAMPLE 2

A solution was prepared using 5 percent potassium pentaborate pentahydrate, 90 percent water, and 5 percent of the soap described in Example 1. The pH of this solution was 8.4. The viscosity was 6 seconds at 60° C. and 7 seconds at 30° C. Drawability ratings of coatings applied at both temperatures were 5. The solution's pH was then adjusted to 8.7 at 60° C. with 1.0 N sodium hydroxide with no change in either the viscosities or drawability ratings. The pH was then adjusted to 9.3 at 60° C. and 12 seconds at 30° C. The drawability of coatings applied at both temperatures decreased to 4. A further pH increase to 9.7 with 1.0 N sodium hydroxide increased solution viscosity dramatically to more than 20 seconds at 60° C. At this viscosity it became very difficult to obtain a uniform coating on the test strip. At 30° C. the material formed a hard gel.

EXAMPLE 3

A solution was prepared containing 6 percent sodium soap, 4 percent sodium tetraborate pentahydrate and 90 percent water. The pH of the solution was 9.0 at 60° C. Two cold rolled mild steel panels were dip coated in this solution at 60° C. for 2 minutes and allowed to air dry at 27° C. for two hours. These panels were then placed in a Q-C-T Cyclic Environmental Tester for corrosion evaluation (ASTM D-2247-68). Severe corrosion developed in less than 30 hours on both panels. A set of panels coated at 30° C. could not be evaluated due to the solution being a hard gel at this temperature.

A similar solution was prepared using 2.0 percent sodium tetraborate pentahydrate, 2.0 percent boric acid, 6.0 percent sodium soap and 90 percent water. The pH of this solution was 8.7 at 60° C. Steel panels could be coated in this solution at both 60° C. and 30° C. where the viscosities were 6 seconds (Zahn #5) and 9 seconds respectively. The coated panels remained in the Q-C-T tester for 300 hours, the maximum test duration, with no evidence of corrosion.

EXAMPLE 4

Results similar to those in Example 3 were obtained when monosodium phosphate was used in place of boric acid to adjust the solution pH except that the pH of the solution with the monosodium phosphate was 8.9 at 60° C.

EXAMPLE 5

A solution prepared with 6 percent sodium soap, 4 percent potassium pentaborate pentahydrate and 90 percent tap water (sequence of addition to water is inconsequential). The solution was then heated to 150° F. Four panels were then coated individually by a two minute immersion at 150°–160° F. and allowed to air dry from two hours. Two panels were then placed in the Q-C-T tester and two evaluated for drawability. The drawability rating was determined to be 5 for both panels and the panels in the Q-C-T tester were removed after 300 hours with no evidence of corrosion on the coated portion. Panels similarly coated with the solution cooled to 80° F. showed identical results. The pH of the solution was 8.7.

EXAMPLE 6

A solution was prepared and panels coated in a manner identical to that in Example 5 except that ammonium pentaborate octahydrate was used in place of the potassium pentaborate pentahydrate. The coated panels showed a drawability of 5 and a corrosion rating of 300 hours at both solution temperatures (160° F. and 80° F.). Solution pH was 8.2.

EXAMPLE 7

A solution was prepared and panels coated in a manner identical to that in Example 5 except that sodium octoborate tetrahydrate was used in place of the potassium pentaborate pentahydrate. The coated panels showed a drawability of 5 and a corrosion rating of 300 hours at both solution temperatures (160° F. and 80° F.). Solution pH was 8.2.

EXAMPLE 8

A solution was prepared containing 7.5 percent by weight potassium pentaborate decahydrate and 7.5 percent by weight soap in water. The solution had a pH of 8.2 and was fluid at 72° F. The film was evaluated without being dried in the draw test machine previously described at a die pressure of 300 psi. Upon evaluation the draw pressure was a consistent 1400 to 1450 pounds with no scoring, thereby indicating good lubricity.

EXAMPLE 9 (Comparative)

A solution was prepared containing 7.5 percent by weight soap and 7.5 percent by weight borax pentahydrate in water. The resultant gel had a pH of 9.0 at 72° F. and the film was applied to the panel to a thickness of 4 mils with a wire wound drawn down bar. The resultant pressure necessary to keep the gripping assembly moving at a constant was in excess of 2200 pounds, showing very poor lubricating properties and severe scoring.

EXAMPLE 10

The solution in Example was adjusted to a pH of 7.7 with a 15 percent by weight solution of boric acid. The solution became completely fluid at this pH at 72° F. When evaluated in the draw test machine the pressure was a consistent 1400–1450 pounds with no scoring, indicating good lubricity.

EXAMPLE 11

A solution was prepared by mixing together 2.1 percent by weight potassium hydroxide, 7.9 percent by weight boric acid and 7.1 percent by weight toll oil fatty acid of acid number 193, saponification value of 195 and an iodine number of 132, the remainder being water. The pH of this mixture was adjusted to 8.2 with potassium hydroxide after stirring the mixture constantly for one hour at 160° F. After cooling this solution was fluid at 72° F. When evaluated in the draw test machine the pressure was consistent 1170 pounds with no scoring, indicating good lubricity.

It will be readily apparent from Example 11 that an aqueous soap-borate composition in accordance with this invention may be prepared in situ from boric acid and the appropriate basic moiety.

Further tests were run in accordance with Examples 1–10 and are summarized in Table 1.

A composition in accordance with this invention has been utilized on a commercial coil coating line on 0.055 gauge 409 stainless steel. A ten percent aqueous solution of the drawing compound at 70°–80° F. was applied with a reverse roll coater. The coil was then passed through a 110 foot oven which is normally used for curing paints. The oven was shut down and access doors opened prior to the coating being applied. The oven temperature was approximately 200° F. with a line speed of 90–100 feet per minute. The weight of the dried coating varied between 500 and 700 milligrams per square foot. This steel was then shipped to a customer where extremely difficult drawn parts were produced very successfully. In normal use while drawing these difficult to draw parts, highly viscous oils containing molybdenum disulfides are required. Such oils are quite expensive, and deposit heavy films which are difficult to remove from the drawn parts by normal cleaning processes. In general, such films would have to be removed prior to welding the parts. On the other hand, the parts produced by use of the composition of this invention may be welded without cleaning and depending upon the final use requirements of the part, the film deposited by the composition of this invention may be allowed to stay on the part and may actually assist the welding operation.

While the preferred total solids content of the soap and borate ion producing compound is within the range of about 10 to 15 percent of the aqueous solution, effective compositions in accordance with this invention may contain as low as 3 percent as a wet film, 5 percent total solids as a dry film total solids based on the soap and borate ion producing compound, and may be as high as the saturation point of the mixture of soap and borates for different draws.

TABLE 1

| % Soap of Total Solids | Type of Borate | pH | Drawability Rating | Hours to Corrosion | Solution Character at low Temp. 80° F. |
|---|---|---|---|---|---|
| 100 | — | 10.4 | 3 | 5 | Gel |
| 80 | KPB | 8.9 | 5 | 160 | Gel |
| 60 | | 8.7 | 5 | 160 | OK |
| 40 | | 8.1 | 4 | 300 | PW |
| 20 | | 7.9 | 3 | 300 | PW |
| 10 | | 7.7 | 3 | 300 | PW |
| 80 | Borax | 9.0 | 3 | 10 | Gel |
| 60 | | 9.0 | 4 | 30 | Gel |
| 40 | | 9.0 | 3 | 30 | Gel |
| 20 | | 9.0 | 3 | 200 | Gel |
| 10 | | 8.9 | 3 | 200 | Gel |
| 80 | AM.PB | 8.9 | 5 | 300 | OK |
| 60 | | 8.2 | 5 | 300 | OK |
| 40 | | 7.8 | 4 | 300 | PW |
| 20 | | 7.6 | 3 | 300 | PW |
| 10 | | 7.3 | 3 | 300 | PW |
| 50% Soap | | 9.0* | 4 | | Gel |
| 50% Borax | pH adjusted with 1.0 N HCl | 8.4 | 4 | | Gel |
| | | 7.8 | 5 | | OK |

*UnadjustedPW—Poor Wetting
KPB—Potassium Penta Borate Pentahydrate (pH = 7.6–8.5)
Borax—Sodium Tetraborate Penta Hydrate (pH = 9.0)
AM.PB—Ammonium Pentaborate Octa Hydrate (pH = 7.7–8.5)

Having thus described our invention, we claim:

1. In a process of working metal pieces, the steps which comprise (1) coating the surface of the metal with a drawing compound by applying thereto an aqueous solution of a mixture of a soap and a compound which produces a borate ion, the soap and the borate ion producing compound having relative proportions of from about 1:4 to about 4:1 and said aqueous solution having a pH within the range of from about pH 7.6 to less than about pH 9, and thereafter (2) working said metal piece.

2. The process of claim 1 wherein the total solids weight of the soap and the borate ion producing compound is at least about 3 percent of the solution.

3. The process of claim 1 wherein the borate ion producing compound is selected from the class consisting of potassium pentaborate, ammonium pentaborate and sodium pentaborate.

* * * * *